US009175688B2

(12) United States Patent
Neel

(10) Patent No.: US 9,175,688 B2
(45) Date of Patent: Nov. 3, 2015

(54) VACUUM PUMPING SYSTEM HAVING AN EJECTOR AND CHECK VALVE

(75) Inventor: Thierry Neel, Meythet (FR)

(73) Assignee: ADIXEN VACUUM PRODUCTS, Annecy (FR)

( * ) Notice: Subject to any disclaimer, the term of this patent is extended or adjusted under 35 U.S.C. 154(b) by 510 days.

(21) Appl. No.: 13/505,337

(22) PCT Filed: Oct. 27, 2010

(86) PCT No.: PCT/FR2010/052305

§ 371 (c)(1),
(2), (4) Date: May 1, 2012

(87) PCT Pub. No.: WO2011/061429

PCT Pub. Date: May 26, 2011

(65) Prior Publication Data

US 2012/0219443 A1 Aug. 30, 2012

(30) Foreign Application Priority Data

Nov. 18, 2009 (FR) ..... 09 58138

(51) Int. Cl.
*F04D 19/04* (2006.01)
*F04D 19/02* (2006.01)
(Continued)

(52) U.S. Cl.
CPC ..... *F04D 19/046* (2013.01); *F04C 23/005* (2013.01); *F04C 25/02* (2013.01);
(Continued)

(58) Field of Classification Search
CPC ..... F04F 9/08; F04F 5/20; F04F 5/54; F04F 5/52; F04F 5/16; F04D 15/0254; F04D 19/02; F04D 19/04; F04D 19/042; F04D 19/046; F04D 27/004; F04D 15/0281; F04D 25/16; F04D 27/00
USPC ..... 417/2, 79, 44.1, 44.2, 85, 87, 89, 170, 417/187, 202, 4, 423.4
See application file for complete search history.

(56) References Cited

U.S. PATENT DOCUMENTS 3,064,878 A * 11/1962 Bayles et al. ..... 417/54
3,239,131 A 3/1966 Whyte
(Continued)

FOREIGN PATENT DOCUMENTS

EP 1 234 982 A1 2/2002
EP 1 609 990 A1 12/2005
(Continued)

OTHER PUBLICATIONS

PCT Search Report of the ISA for PCT/FR2010/052305 dated May 22, 2012; 3 pages.
(Continued)

*Primary Examiner* — Bryan Lettman
*Assistant Examiner* — Timothy P Solak
(74) *Attorney, Agent, or Firm* — Daly, Crowley, Mofford & Durkee, LLP

(57) ABSTRACT

A pumping device and method are described. The pumping device comprises a dry rough vacuum pump equipped with a gas inlet connected to a vacuum chamber, a gas outlet leading to a conduit and an ejector. The pumping method comprises pumping gases contained in the vacuum chamber using the dry rough vacuum pump through the gas inlet, measuring electric power consumed by the dry rough vacuum pump and the pressure of the gases in the conduit, starting the ejector, when the pressure of the gases at the outlet and the electrical power consumed cross respective set point values as they rise and stopping the ejector when the electric power consumed and the pressure of the gases in the conduit at the outlet cross respective set point values as they fall.

16 Claims, 3 Drawing Sheets

(51) Int. Cl.

| | |
|---|---|
| ***F04D 15/02*** | (2006.01) |
| ***F04D 25/16*** | (2006.01) |
| ***F04D 27/00*** | (2006.01) |
| ***F04F 5/20*** | (2006.01) |
| ***F04F 5/52*** | (2006.01) |
| ***F04C 23/00*** | (2006.01) |
| ***F04C 25/02*** | (2006.01) |
| ***F04F 5/54*** | (2006.01) |

(52) U.S. Cl.
CPC ..... *F04D15/0254* (2013.01); *F04D 15/0281* (2013.01); *F04D 19/02* (2013.01); *F04D 25/16* (2013.01); *F04D 27/004* (2013.01); *F04F 5/20* (2013.01); *F04F 5/54* (2013.01); *F04C 2220/12* (2013.01); *F04C 2270/02* (2013.01)

(56) References Cited

U.S. PATENT DOCUMENTS

| | | | | |
|---|---|---|---|---|
| 3,575,532 | A * | 4/1971 | Mugele et al. | 417/69 |
| 4,699,570 | A * | 10/1987 | Bohn | 417/6 |
| 6,644,931 | B2 * | 11/2003 | Puech | 417/205 |
| 8,506,263 | B2 | 8/2013 | Chatfield | |
| 2002/0131870 | A1 | 9/2002 | Puech | |
| 2002/0144739 | A1 * | 10/2002 | Schnatterer et al. | 137/832 |
| 2003/0068233 | A1 * | 4/2003 | Royce et al. | 417/251 |
| 2004/0173312 | A1 * | 9/2004 | Shibayama et al. | 156/345.29 |
| 2006/0182638 | A1 * | 8/2006 | Ohmi | 417/87 |

FOREIGN PATENT DOCUMENTS

| | | |
|---|---|---|
| JP | 63-085292 | 4/1988 |
| JP | 2003-139055 | 5/2003 |
| JP | 2006-037868 | 2/2006 |
| TW | 200523475 | 7/2005 |

OTHER PUBLICATIONS

English Translation of Written Opinion of ISA for Int'l. Appl. No. PCT/FR2010/052305 dated Aug. 8, 2012.
English Translation of Chinese Office Action for Appl. No. 2010805522232.
Taiwan IPO Search Report dated Feb. 26, 2014; Application No. 099137629 filed Nov. 2, 2010.
English Translation of the International Search Report, PCT/FR2010/052305, May 22, 2012, 2 pages.

* cited by examiner

VACUUM PUMPING SYSTEM HAVING AN EJECTOR AND CHECK VALVE

CROSS REFERENCE TO RELATED APPLICATIONS

This application is a National Stage application of PCT/FR2010/052305 filed on Oct. 27, 2010, and published in the French language and entitled "Method And Device For Pumping With Reduced Power Use" which claims priority to French application FR0958138 filed on Nov. 18, 2009.

The present invention pertains to a pumping method that makes it possible to reduce the electrical power consumption of a dry rough vacuum pump, and the pumping apparatus for implementing it. It particularly pertains to rotating-lobe dry rough vacuum pumps, such as a roots pump, a claw pump, a spiral pump, a screw pump, a piston pump, etc., both in single-stage and multi-sage versions.

These dry vacuum pumps are particularly intended for pumping load lock chambers, transfer chambers, or PVD ("Physical Vapor Deposition") chambers in semiconductor component, flat screen, or photovoltaic substrate fabrication units. The steps of treating semiconductor wafers are carried out in a very low-pressure atmosphere (in a vacuum) within a process chamber, in which the atmosphere must be controlled to prevent the presence of any impurities.

In order to avoid pollution, the substrates are packed and brought one at a time using robotic means into a load lock chamber which connects to a transfer chamber, which in turn precedes the process chamber. The load lock chamber and the transfer chamber are then brought to a low pressure on the order of a rough vacuum (about $10^{-1}$ mbar), similar to that which exists within the process chamber, in order to allow the wafer to be transferred. To do so, a gas pumping system is used comprising a rough vacuum pump connected by a pumping circuit to the chamber to be pumped out, which may be the load lock chamber or the transfer chamber, in order to pump the gases until a level of pressure is reached which would permit the transfer of the wafer into the chamber, i.e. about $10^{-1}$ mbar.

In order to lower the pressure within the chamber from atmospheric pressure to a transfer pressure on the order of $10^{-1}$ mbar, the pumping system must pump a relatively high flow of gases at the start of pumping. The decreasing of the pressure within the chamber is done in two steps, the first step corresponding to going down from atmospheric pressure to transfer pressure ($10^{-1}$ mbar). Once transfer pressure has been achieved, the pumping system continues to operate with zero gas flow. The pressure decrease and increase cycles alternate at a high frequency, and consume a large quantity of energy, particularly due to the increase to atmospheric pressure. Decreasing the power consumed by these pumping systems would have a significant impact on the overall electrical power savings of a semiconductor fabrication unit.

In the semiconductor industry, dry rough vacuum pumps represent about 50% of the vacuum pump fleet of a semiconductor fabrication unit, and about 40% of the unit's overall power consumption. Out of a desire to optimize energy costs in the semiconductor industry, the electrical power consumption of these pumping systems must be decreased. Many efforts have been carried out to reduce electrical power expenditures by altering the vacuum pump's components. These actions have particularly dealt with losses due to friction, the size of the compression stages, the use of a frequency converter on the motor, the IPUP™ (for "Integrated Point-of-Use Pump") concept applied to dry rough vacuum pumps, and the optimization of pumping cycles.

The electrical power needed for gas compression is one of the major parameters in the power consumption of dry rough vacuum pumps. This compression power is mainly used in the last two stages of compression for a multistage roots or claw pump, and in the last steps for a screw pump. This electrical power consumed during the last stages of compression is proportional to the compression rate (the difference in pressure between the inlet and outlet of the compression stage), to the volume driven by the compression cycle (driven cyclical volume), and to the mass flow of the pumped gas. These parameters must therefore be reduced to decrease power consumption.

"Driven cyclical volume" refers to the flow rate of a pump compared to the volume of its components, as the flow rate varies with the size of the volume transferred with each rotation (the geometric dimension of the parts) and with the rotational velocity. To increase the volume flow of a pump, it is necessary to increase the pump's driven cyclical volume or its rotational velocity, all dimensions being otherwise equal.

Reducing the electrical power consumed by a multistage dry pump may be achieved by undersizing the pump's last compression stage, but this power reduction is limited. This is because, in a multistage dry pump, the gas undergoes multiple successive compressions in the pump's various stages, from the suction pressure at the first stage's inlet to atmospheric pressure at the last stage's outlet. Beginning at a certain dimension of the last discharge stage, the dry rough pump will no longer have the capacity to pump high gas flows during the first pumping stage of the process chamber. Thus, this sizing optimization does not make it possible to achieve the decrease in power consumption sought here, which is on the order of 50%.

The decrease in flow rate in the last compression stage runs up against limits imposed by the driven cyclical volume, the pumping speed, and the length/diameter ratio of the lobes of roots or claw pumps. Increasing the pumping speed, which requires a final suction stage in the large-dimension vacuum pump, runs counter to the desire to reduce the consumed electrical power, which requires a reduced size in the last compression stage instead. Furthermore, building small-dimension stages requires assembly or machining technologies that may prove complex or expensive.

Furthermore, despite all reduction efforts, residual consumption remains, particularly when the vacuum pump's job is to maintain the existing vacuum after the pressure-lowering phase, such as in a load lock chamber.

Arrangements are also known which make it possible to reduce the overall power consumption of the pumping apparatus by using a main dry rough vacuum pump and an auxiliary dry vacuum pump connected to the discharge of the main pump. The recommended auxiliary pumps are either membrane pumps, piston pumps, or scroll pumps.

With the aim of lowering the power consumption of a vacuum apparatus, adding an auxiliary pump to the apparatus's main multistage vacuum pump is proposed. The main dry vacuum pump, such as a roots pump, includes a first compression stage connected to a process chamber by a suction orifice and a last compression stage whose discharge orifice is connected to a conduit that includes a check valve. The auxiliary pump's suction orifice is connected to the terminal stage of the apparatus's main vacuum pump and may be installed parallel to the check valve. The auxiliary pump is a primary gede, scroll, piston, or membrane pump.

Nonetheless, the auxiliary pump consumes a non-negligible amount of electrical power, which limits the benefit of this proposal. In particular, when the volume of gas pumped by the main vacuum pump is high, the total electrical consumption is higher than when there is no auxiliary pump. However, in order to achieve a reduction in electrical consumption, it is necessary to optimize several operating parameters, such as the auxiliary pump's pumping speed and the intake pressure into the main vacuum pump.

However, at the start of pumping, this energy saving is not achieved. It is then proposed to start emptying the process chamber by means of the auxiliary vacuum pump until a certain pressure threshold has been reached, then to start up the main vacuum pump. Once the desired pressure has been achieved, the vacuum is maintained by means of the auxiliary vacuum pump alone.

Furthermore, concepts incorporating an auxiliary roots, claw, or hook vacuum pump, which may be a peristaltic, membrane, or screw pump, that may be placed at the outlet of the main dry rough vacuum pump, have already been proposed. Nonetheless, the electrical consumption of the auxiliary pumps, caused by constant operation, does not make it possible to achieve the substantial energy savings being sought.

The goal of the present invention is to propose a method for pumping a vacuum chamber making it possible to substantially reduce (by about 50%) the electrical consumption of a dry rough vacuum pump, within a short period of time (a few seconds).

A further goal of the invention is to propose a pumping apparatus comprising a dry rough vacuum pump whose electrical consumption is reduced.

A further goal of the invention is to propose an apparatus for controlling the pumping method used to achieve a substantial decrease in the electrical consumption of a dry rough vacuum pump.

The object of the present invention is a method for pumping by means of a pumping apparatus comprising a dry rough vacuum pump fitted with a gas inlet orifice connected to a vacuum chamber, and with a gas outlet orifice opening out onto a conduit. The method comprises the following steps:

the gases contained in the vacuum chamber are pumped using the dry rough vacuum pump through the gas inlet orifice, the gas outlet orifice of the dry rough vacuum pump is connected to an ejector, the electric power consumed by the dry rough vacuum pump and the pressure of the gases in the conduit at the outlet of the dry rough vacuum pump are measured, the ejector is started, after a time delay, when the pressure of the gases at the outlet of the dry rough vacuum pump crosses a set point value as it rises and the electrical power consumed by the dry rough vacuum pump crosses a set point value as it rises, the ejector is stopped when the electric power consumed by the dry rough vacuum pump has crossed a set point value as it falls and the pressure of the gases in the conduit at the outlet of the dry rough vacuum pump has crossed a set point value as it falls.

According to a first aspect of the invention, the gas pressure's set point value within the conduit at the dry rough vacuum pump's outlet is less than or equal to 200 mbar.

According to a second aspect of the invention, the set point value of the electrical power consumed by the dry rough vacuum pump is greater than or equal to the minimum electrical power consumed, increased by 200%.

The dry rough vacuum pump is started once the method begins, in order to create a vacuum within the chamber to which it is connected. Pumping continues until the rough vacuum pump's primary pressure, about $10^{-1}$ mbar, has been reached. Once this pressure has been reached, the ejector is activated for a very short period of time while the rough vacuum pump continues to operate.

The invention resides in the fact that operation, assisted by coupling the dry rough vacuum pump and the ejector, will only require a few seconds for the ejector to operate, for a dry rough vacuum pump operating time in low-consumption mode that may continue indefinitely for as long as the pumping line is not being fed a new gas inflow. The depressurization of the dry rough vacuum pump by the ejector does not require electrical power, as the ejector uses a compressed fluid. The ratio of fluid consumed by the ejector over electrical power savings on the dry rough vacuum pump may thereby vary, depending on the vacuum pump's usage situations, from 1/10 to more than 1/1000.

A further object of the present invention is a pumping apparatus comprising a dry rough vacuum pump fitted with a gas inlet orifice connected to a vacuum chamber, and a gas outlet orifice opening out onto a conduit. The apparatus further comprises:

a discharge check valve placed within the conduit at the outlet of the dry rough vacuum pump, an ejector installed in parallel in relation to the discharge check valve, the ejector's intake orifice being connected to the conduit by a first pipe and the ejector's discharge orifice being connected to the conduit by a second pipe.

According to one variant, the pipe connected to the ejector's suction orifice comprises a suction check valve.

According to another variant, the ejector is incorporated into a cartridge which may be placed within the rough vacuum pump's housing.

The dry rough vacuum pump may be chosen from among a single-stage dry rough vacuum pump and a multi-stage dry rough vacuum pump.

In order to overcome the drawbacks of the prior art, the invention therefore proposes to reduce the electrical power consumption of a dry rough vacuum pump by lowering the pressure within the final compression stage using an ejector which consumes no electrical power. To do so, the invention proposes to use a multistage ejector, normally used in the field of handling, which is distinct from vacuum pumps used in the field of semiconductors. An ejector is a static device that operates on the principle of the Venturi effect: a phenomenon of fluid dynamics in which gas or liquid particles are accelerated due to a bottleneck in their area of circulation, with suction occurring at the narrow point. When the compressed gas passes through the nozzles, suction occurs through each stage. An ejector makes it possible to achieve suction without using moving parts, thus avoiding both wear and maintenance, which is not true of, say, a membrane or piston pump. An ejector makes it possible to create a vacuum using a compressed fluid, such as a gas like nitrogen or compressed air for example, and therefore without consuming electrical power.

Additionally, this ejector is very small: its size is slightly larger than a matchstick, which is not true of a membrane or piston pump. Thus, it may easily be incorporated into the housing of a vacuum pump, which enables substantial savings in volume.

According to one variant, the ejector is incorporated into a cartridge which may be placed within the housing of the dry rough vacuum pump.

According to one embodiment, the dry rough vacuum pump's gas outlet orifice opens out onto a conduit fitted with a check valve, the check valve being placed between the dry rough vacuum pump and the ejector.

This pumping apparatus according to the invention makes it possible to lower the pressure at the outlet of the rough vacuum pump, thereby reducing heating in the rough vacuum pump's last compression stage.

A further object of the present invention is an apparatus for controlling the previously described pumping method, comprising:

means for measuring the pressure within the conduit at the outlet of the dry rough vacuum pump, means for measuring the electrical power consumed by the dry rough vacuum pump, means for controlling the supply of motive fluid to the ejector, means for selecting the dry rough vacuum pump's rotational velocity.

Other characteristics and advantages of the present invention will become apparent upon reading the following description of one embodiment, which is naturally given by way of a non-limiting example, and in the attached drawing, in which:

FIG. 1 depicts one embodiment of the inventive vacuum apparatus,

FIG. 2 schematically depicts the operation of an ejector,

Figure 1:
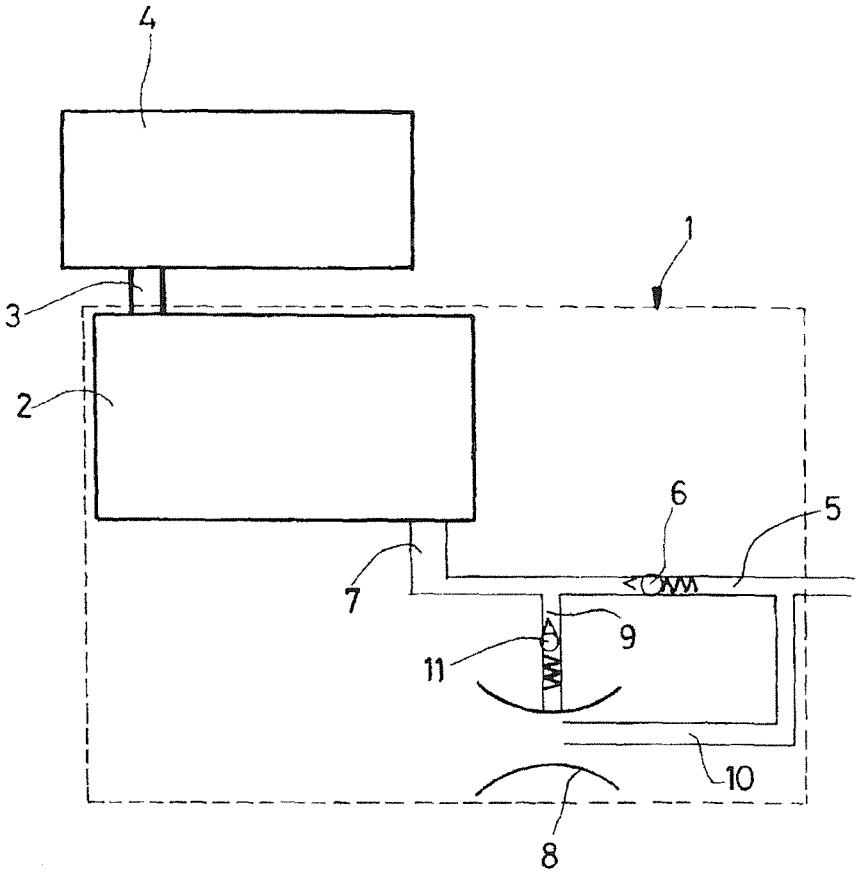

In the embodiment of the invention depicted in FIG. 1, a pumping apparatus 1 comprises a dry rough vacuum pump 2, for example a multistage roots vacuum pump, whose suction orifice is connected by a conduit 3 to a chamber 4 to be emptied out, such as a load lock chamber, a transfer chamber, or a process chamber. The gas outlet orifice of the vacuum pump 2 is connected to a conduit 5. A discharge check valve 6 is preferentially placed on the conduit 5, in order to enable the isolation of a volume 7 contained between the gas outlet orifice of the rough vacuum pump 2 and the check valve 6. The rough vacuum pump 2 sucks in the gases of the chamber 4 at its inlet, and compresses them to discharge them at its outlet into the conduit 5 through the discharge check valve 6. Once the working pressure limit of the rough pump 2 has been reached, the check valve 6 closes in order to prevent any pressure increase from the atmosphere to the gas outlet orifice of, the rough vacuum pump 2.

The pumping apparatus 1 further comprises an ejector 8 placed parallel to the discharge check valve 6, and whose suction orifice and discharge orifice are respectively connected to the conduit 5 by first 9 and second 10 pipes installed so as to bypass the conduit 5. A suction check valve 11 placed within the conduit 9, connected to the suction of the ejector 8, isolates the ejector 8 from the dry rough vacuum pump 2. When the discharge check valve 6 closes, the ejector 8 may then be triggered depending on the combination of a set point value Wc of the electrical power consumed by the rough vacuum pump 2 and a set point value Pc of the pressure measured within the volume 7 contained within the gas outlet orifice of the rough vacuum pump 2 and the check valve 6.

To operate, the ejector 8 needs a pressurized motive fluid. The motive fluid, which may, for example, be nitrogen or compressed air, is sent for a period of time, for example less than 3 seconds, to the input of the ejector 8, which causes depressurization at the suction check valve 11, which opens, thereby allowing the emptying of the 2 $cm^3$ volume 7. The pressure Pm measured within the volume 7 drops from the atmospheric pressure value of 1013 mbar down to a measured value Pm below a set point value Pc, which, for example, is on the order of 200 mbar. Once the measurement of the electrical power Wm consumed by the rough vacuum pump 2 falls below the set point value Wc and the pressure Pm measured within the volume 7 drops below the set point value Pc, the ejector 8 is shut off. The valve 11 closes again, thereby isolating a volume 7 of 2 $cm^3$ at a pressure Pm whose value is less than the set point value Pc. This pressure value Pm may be maintained for 24 hours during a vacuum maintaining phase, without it being necessary to reactivate the ejector 8. If an increase in pressure which brings the value Pm above the set point value Pc is detected, the ejector 8 may be activated again.

The volume 7 contained between the gas outlet orifice of the rough vacuum pump 2 and the discharge check valve 6 is minimized by design, in order to reduce the size of the ejector 8 and to shorten the time needed to empty out that volume 7. Nonetheless, the ejector 8 may, as desired, be incorporated into the body of the rough vacuum pump 2, in order to minimize the total volume to pump, or be installed on the conduit 5 connected to the gas outlet orifice 2 and comprising a discharge check valve 6.

The average time needed to empty out the chamber 4 by means of the rough vacuum pump 2 is between 4 and 18 seconds, for example when a vacuum pump is used which has a flow rate of about 100 $m^3$/h. The average time is around 4 seconds for an average chamber volume of 6 liters.

Figure 2:
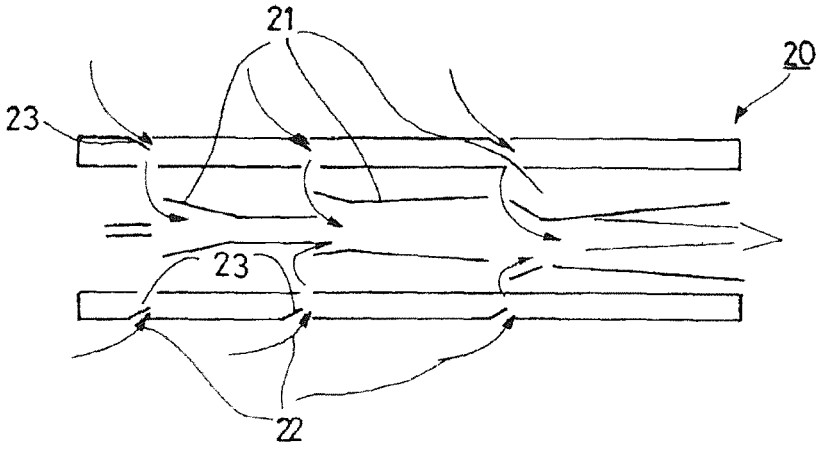

As depicted in FIG. 2, the ejector 20 is preferentially multistage and made up of at least three stages in order to achieve a pressure Pm less than the set point value Pc (for example, on the order of 200 mbar) with zero pumped flow as quickly as possible, which is done in order to reduce the consumption of compressed fluid (nitrogen or air, for example) needed to operate the ejector 20 as much as possible. Nonetheless, the ejector may be made up of either one or two stages depending on the pressure value Pm to be obtained.

The ejector 20 comprises multiple nozzles 21 assembled serially forming suction stages. Each nozzle 21 comprises orifices 22 connecting with the outside space and valves 23 which make it possible to stop up the connecting orifices 22.

Figure 3:
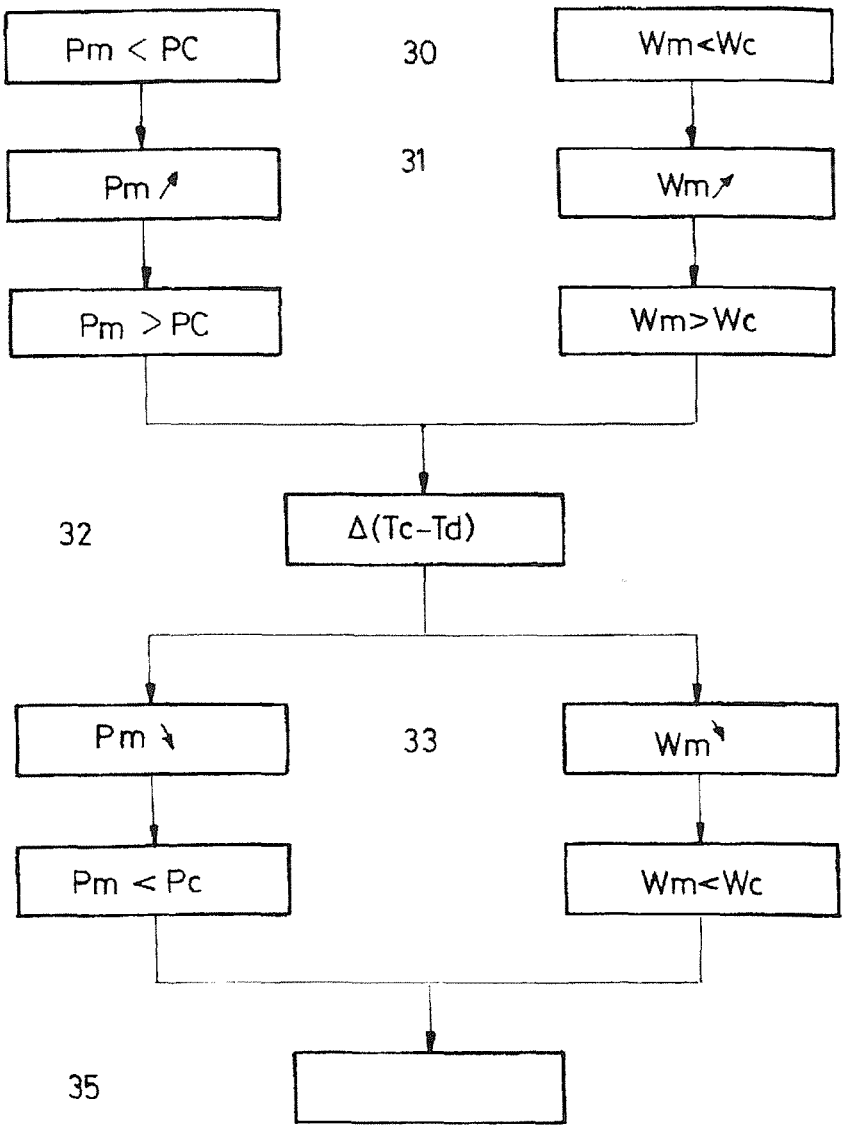
FIG. 3 depicts the inventive pumping method.
Figure 4:
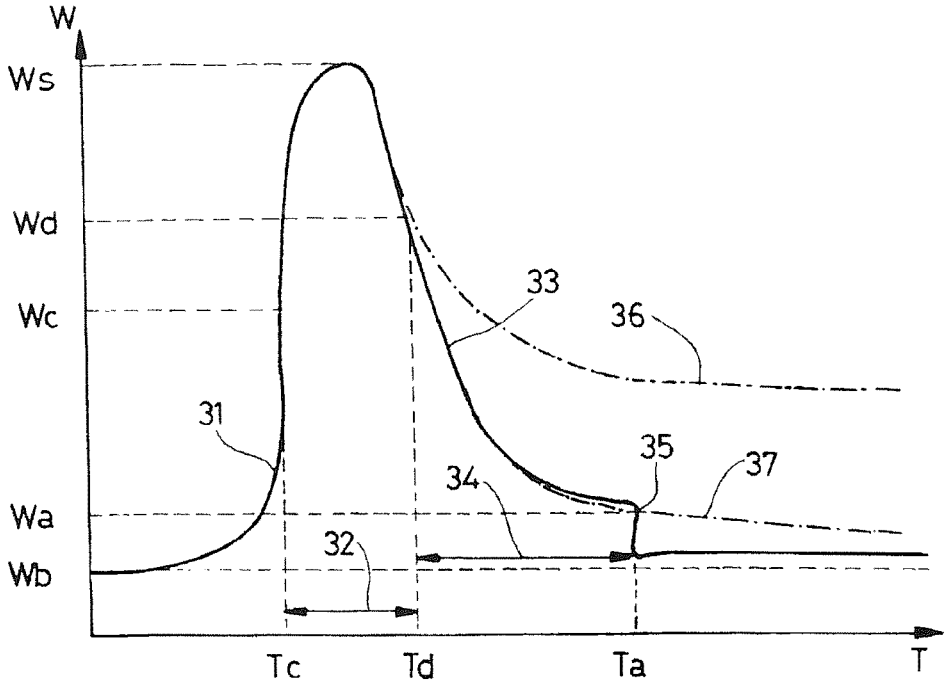
FIG. 4 shows the change in electrical power W consumed by the dry rough vacuum pump in watts, which is depicted on the y-axis, as a function of elapsed time T in seconds, depicted on the x-axis.

We shall now examine FIGS. 3 and 4, which depict the pumping method according to one embodiment of the invention.

When a vacuum chamber is in the vacuum-maintaining phase 30 the rough vacuum pump 2 operates at a low rotational velocity, such as 50 Hz, known as "standby mode", and the electrical power consumed Wm is moderate, on the order of 200 W for example, for a multistage roots vacuum pump. This electrical power consumed Wm is at a minimum value Wb that can be maintained for a period that may exceed 20 hours.

If the vacuum chamber 4 receives more gas, the vacuum pump 2 accelerates its rotational velocity, going from 50 to 100 Hz, in order to achieve its set point velocity. This velocity-increasing phase 31 consumes a lot of electrical power, because it involves overcoming all of the inertial forces of the moving parts within the dry rough vacuum pump 2. The electrical power Wm needed by the rough vacuum pump 2 quickly increases until it reaches a maximum electrical power Ws.

The electrical power Wm consumed by the rough vacuum pump 2 is continually measured so as to detect the precise moment Tc when the consumed electrical power Wm reaches and passes (as it rises) the electrical power set point value Wc set beforehand. In this situation, this electrical power set point Wc is chosen so as to be as far as possible from the minimum electrical power Wb of the phase 30, e.g. for example Wb+200%. The electrical power set point value Wc is detected by detecting a current threshold on the speed selector controlling the motor of the rough vacuum pump 2, for example. The detecting of the consumed electrical power set point value Wc triggers a time delay 32 equal to Δ(Tc−Td) distinguishing the moment Td when the ejector 8 is triggered. The time delay function makes it possible to turn on the ejector 8 during the optimal range in the pumping sequence, meaning at the end of the first phase 31 of pumping at high speeds, and not throughout the entire pumping cycle. Outside of that optimal range, the ejector 8 actually provides no notable savings in the consumption of the vacuum pump 2. This time delay function makes it possible to accept a volume range for the chamber 4 to be emptied out ranging from 3 liters to 25 liters. The time delay 32 is contained between 0.1 and 10 seconds and makes it possible to cover the majority of situations.

At the same time, the pressure Pm measured within the volume 7 reaches and passes its set point value Pc as it rises. The controlling of the ejector's 8 startup is therefore contingent on observing both that the pressure Pm measured within the volume 7 has passed its set point value Pc and that the measured electrical power Wm has also passed its set point value Wc. The combination of these two criteria enables an optimization of motive fluid consumption within the ejector 8.

The start-up of the ejector 8 creates a low pressure within the volume 7 of the conduit 5 connected to the gas outlet orifice of the primary vacuum pump 2. This reduces the pressure gap between the last stage of the primary vacuum pump 2 and the conduit 5, proportionally reducing the electrical power Wm consumed by the rough vacuum pump 2. During the assisted pumping phase 33 the ejector 8 is triggered and more quickly relaxes the primary vacuum pump 2, thereby offsetting the increase in electrical power needed to compress the gases against the atmospheric pressure of 1013 mbar, which simultaneously causes the reduction in the pressure Pm within the volume 7.

At the end of the assisted pumping phase 33, the electrical power Wm again crosses the set point value We as it falls. Next, after a certain operating time 34, the shutdown 35 of the ejector 8 is triggered at the determined moment Ta based on the measurement of the pressure Pm within the volume 7 contained within the gas outlet orifice of the primary vacuum pump 2 and the discharge check valve 6. Once the pressure Pm within the volume 7 located at the outlet of the vacuum pump 2 has dropped down to the set point value Pc and the electrical power Wm consumed by the rough vacuum pump 2 is already below the set point value Wc, the suction check valve 11 is closed to isolate the conduit 9 connected to the suction of the ejector 8 and keep the volume 7 at a pressure Pm below the set point value Pc. Subsequently, the supplying of the ejector with motive fluid 8 is stopped in order to optimize the fluid consumption.

Figure 5:
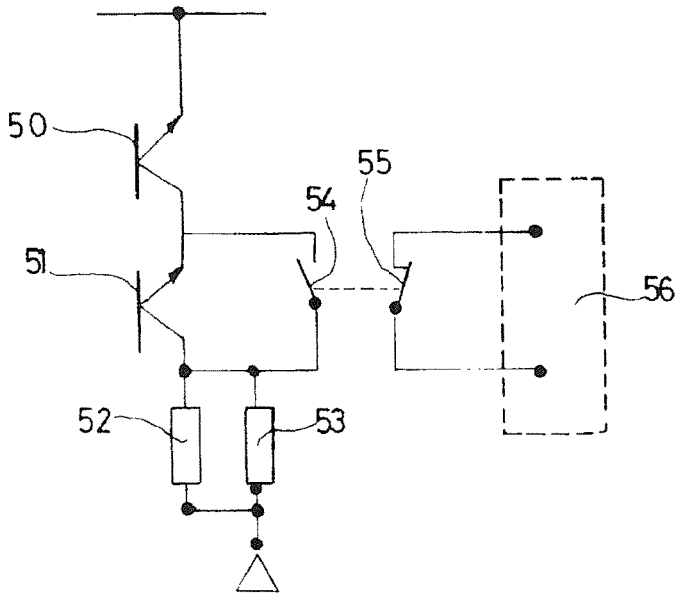
FIG. 5 depicts one embodiment of an apparatus for controlling the inventive pumping method.

FIG. 5 depicts an ejector-controlling apparatus. This apparatus comprises a contact 50 for detecting the pressure set point value Pc within the volume 7 and a contact 51 for detecting the electrical power set point value Wc. A valve 52 coupled to a relay 53 controls the supply of the ejector's 8 motive fluid. A contact 55 makes it possible to activate the speed selector 56 in order to adjust the rotational velocity of the rough vacuum pump 2 within the range 50-100 Hz.

The contact 50 and the contact 51 are depicted as normally being open (i.e. no-pass), which corresponds to the situation in which pressure Pm is less than the set point value Pc, on the order of 200 mbar, and in which the consumed electrical power Wm is less than a set point value Wc which may be equal to Wb+200%. The valve 52, which controls the ejector's 8 motive fluid, therefore cannot be activated in this situation.

During the high-speed pumping phase 31, the pressure Pm increases until it has reached atmospheric pressure within the volume 7 contained between the gas outlet orifice of the rough vacuum pump 2 and the check valve 6. The electrical power Wm consumed by the dry rough vacuum pump 2 also increases.

First, the contact 50 reacting to the detection of the set point value of the pressure Pc switches and becomes pass-through. Second, the information of crossing the electrical power set point value Wc as it rises is received, and the time delay adjusted to a value between 0.1 and 10 seconds is triggered. At the end of the time delay period, the contact 51 closes, which becomes pass-through in turn.

The valve 52 which controls the ejector's 8 motive fluid is then activated to turn the ejector 8 on, enabling the depressurization of the volume 7 located at the outlet of the dry rough vacuum pump 2.

The valve 52 is supplied by both of the relays 53 and 54 to which the valve 52 is connected. The purpose of the relays 53 and 54 is to ensure the self-supplying of the valve 52 once the electrical power Wm consumed by the rough vacuum pump 2 falls below its set point value Wc, crossing it on the trailing end. The activation of the ejector causes a decrease in the power Wm consumed until it crosses the set point value Wc, triggering the opening of the contact 51. As the contact 50 is still closed, the valve 52 is supplied via the relays 53 and 54. Next, as the pressure Pm measured within the volume 7 has decreased until it has reached a value below its set point value Pc, the opening of the contact 40 acting on the valve 52 causes the motive fluid to stop coming into the ejector 8.

The pressure Pm within the volume 7 being less than the set point value Pc, and the electrical power Wm consumed by the vacuum pump 2 being less than the set point value Wc, the pump's speed may be reduced from 100 Hz to 50 Hz (standby mode) in order to save on consumed power even more. The contact 55 closing makes it possible to directly control this switch to standby mode on the speed selector 56 on the motor of the rough vacuum pump 2. This contact 55 is itself dependent on the relay 53 controlled parallel to the valve 52.

The rough vacuum pump 2 rising to an increased rotational velocity, from 50 Hz to 100 Hz, occurs automatically once the contact 55 opens.

The control apparatus of the rough vacuum pump 2 enables the rough vacuum pump 2 to switch to standby mode once the pressure set point value Pc is reached on the trailing end. Standby mode consists of automatically reducing the rotational velocity of the rough vacuum pump 2 from 100 Hz to 50 Hz. In this standby mode, the decrease in velocity preferably leads to extra savings on the power consumed by the rough vacuum pump. Making the switch into standby mode subject to a set point pressure Pc at the outlet of the rough vacuum pump 2 makes it possible to minimize all risk of significantly changing the pressure of the rough vacuum pump 2 at its inlet.

In FIG. 4, the curve 36 corresponds to operation without starting the ejector and without using standby mode, and the curve 37 is obtained without using standby mode.

The apparatus controlling the ejector 8 makes it possible to turn on the ejector 8 depending on the combination of criteria relating to the electrical power Wm consumed by the rough vacuum pump 2 and the pressure Pm measured within the volume 7, and enables the shutdown of the ejector 8 based on a combination of criteria relating to the electrical power Wm consumed by the rough vacuum pump 2 and the pressure Pm measured within the volume 7.

If the crossing of the pressure set point Pc as it rises were taken into account by itself, the controlling apparatus would mistakenly turn the ejector 8 on. If the crossing of the electrical power set point Wc as it rises were used by itself to control the ejector 8, the rough vacuum pump 2 would only need to get mechanically stuck in order to generate an increase in electrical power Wm, causing the ejector 8 to turn on. The detection of the electrical power set point value Wc being crossed via the motor speed selector 56 of the rough vacuum pump 2 makes it possible to obtain information as it is rising. The value of the electrical power set point Wc must be as far as possible from the initial value Wb of the electrical power in order to maximally delay the start of the ejector 8. In order to be sure that the ejector 8 only starts while the rough vacuum pump 2 is operating, the contact 50 for detecting the pressure set point value Pc and the contact 51 for detecting the electrical power set point value Wc are serially mounted.

During the assisted pumping phase 33 the electrical power set point value We is passed again on the trailing end after a maximum electrical power threshold Ws has been achieved, but the consumed electrical power Wm remains far from the initial electrical power value Wb. The measure of electrical power Wm based on an electrical power set point value Wc therefore can only be used along to control the ejector 8.

During a pumping cycle, the dry rough vacuum pump 2 equipped with a speed selector 56 slows down when it needs to suck in a large gas load. This slowdown corresponds to a spike in the electrical power Wm consumed by the pump when the connection with the chamber 4 is opened. This proves an existing relationship between the pressure measured at the inlet of the dry rough vacuum pump 2 and the electrical power Wm consumed. This spike in electrical power is even greater the higher the initial value of the rotational velocity of the vacuum pump 2 is when the connection with the chamber 4 is opened. Having previously slowed the pump from 100 Hz to 50 Hz, the maximum electrical power Ws will have a much higher peak, slightly optimizing the overall consumption of the rough vacuum pump 2 in the course of a pumping cycle.

The invention claimed is:

1. In a system comprising a load lock vacuum chamber and a pumping device, said pumping device comprising:

a conduit having first and second opposing ends;

a dry rough vacuum pump including a gas inlet orifice coupled to the load lock vacuum chamber, and a gas outlet orifice adapted to couple to a first end of the conduit;

a discharge check valve placed within the conduit; and an ejector placed parallel in relation to the discharge check valve, said ejector comprising:

an ejector Intake orifice adapted to couple to an opening on the first end of the conduit by a first pipe; and an ejector discharge orifice adapted to couple to an opening on the second end of the conduit by a second pipe; and an ejector-controlling apparatus having at least one input and an output with a first one of the ejector-controlling apparatus inputs adapted to couple to the gas outlet orifice, said ejector-controlling apparatus configured to measure pressure of gas in the first end of the conduit and electric power consumed by the dry rough vacuum pump and, in response to the measured gas pressure and the measured electric power, start the ejector after a time delay selected to allow for start of the ejector at a predetermined portion of a first phase of the pumping cycle and not throughout each of a plurality of pumping phases in the pumping cycle once a predetermined pressure has been reached in the load lock vacuum chamber and based upon the measured gas pressure crossing a gas pressure set point value and the measured electrical power crossing a power set point value in the first phase of the plurality of pumping phases in a pumping cycle, or stop the ejector based upon the measured gas pressure crossing the gas pressure set value and the measured electrical power crossing the power set point value.

2. A pumping device according to claim 1, wherein the dry rough vacuum pump is provided as a single-stage dry rough vacuum pump.

3. A pumping device according to claim 1, wherein the first pipe comprises a suction check valve.

4. A pumping device according to claim 3, wherein the dry rough vacuum pump is provided as a single-stage dry rough vacuum pump or a multi-stage dry rough vacuum pump.

5. A pumping device according to claim 1, wherein the dry rough vacuum pump is provided as a multi-stage dry rough vacuum pump.

6. A pumping device according to claim 1, wherein the ejector-controlling apparatus is configured to start the ejector by supplying the ejector with motive fluid.

7. A pumping device according to claim 1, wherein the ejector-controlling apparatus is configured to stop the ejector by ceasing to supply the ejector with motive fluid.

8. A method for pumping with a pumping device in a system including a load lock vacuum chamber and the pumping device, the pumping device including a dry rough vacuum pump fitted with a gas inlet orifice coupled to the load lock vacuum chamber, and a gas outlet orifice opening to a conduit and coupled to an ejector, the pumping device further including a discharge check valve placed within the conduit, wherein the ejector is placed parallel in relation to the discharge check valve, the method comprising:

pumping, via the dry rough vacuum pump, gases contained in the load lock vacuum chamber through the gas inlet orifice;

measuring electric power consumed by the dry rough vacuum pump and pressure of the gases in the conduit at the gas outlet orifice of the dry rough vacuum pump;

once a predetermined pressure has been reached in the load lock vacuum chamber, and in response to rising pressure of gases at the gas outlet orifice of the dry rough vacuum pump crossing a gas pressure set point value and rising electrical power consumed by the dry rough vacuum pump crossing a power set point value in a first phase of a plurality of pumping phases in a pumping cycle, starting the ejector after a time delay selected to allow for starting of the ejector at a predetermined portion of the first phase of the pumping cycle and not throughout each of the plurality of pumping phases in the pumping cycle; and in response to the electric power consumed by the dry rough vacuum pump crossing the power set point value as it falls and the pressure of the gases in the conduit at the gas outlet orifice of the dry rough vacuum pump crossing the gas pressure set point value as it falls, stopping the ejector.

9. A pumping method according to claim 8, wherein the set point value of the electrical power consumed by the dry rough vacuum pump is greater than or equal to a value corresponding to a minimum electrical power consumed, increased by 200%.

10. A pumping method according to claim 8, wherein the gas pressure set point value within the conduit at the dry rough vacuum pump outlet is less than or equal to 200 mbar.

11. A pumping method according to claim 10, wherein the set point value of the electrical power consumed by the dry rough vacuum pump is greater than or equal to a minimum electrical power consumed, increased by 200%.

12. The method of claim 8 further comprising:

controlling a supply of motive fluid to the ejector based upon the measured electric power and the measured pressure; and selecting a rotational velocity of the dry rough vacuum pump.

13. A pumping method according to claim 8, wherein the predetermined pressure is about ten to the minus one ($10^{-1}$) millibar (mbar).

14. A pumping method according to claim 8, wherein the time delay is between about one-tenth (0.1) of a second and about ten (10) seconds.

15. A pumping method according to claim 8, further comprising:

emptying of a predetermined volume of the gases contained in the load lock vacuum chamber during the time delay.

16. A pumping method according to claim 8, wherein stopping the ejector further comprises:

stopping the ejector once a pressure of about 1013 mbar has been reached in the load lock vacuum chamber such that the dry rough vacuum pump alone operates when a pressure of about 1013 mbar has been reached in the load lock vacuum chamber.

* * * * *